US005547009A

United States Patent [19]

Plumer

[11] Patent Number: 5,547,009

[45] Date of Patent: Aug. 20, 1996

[54] DRIVING AND TENSIONING DEVICE FOR A FLEXIBLE PROTECTIVE MEMBER SUCH AS A STRIP, CURTAIN OR SKIRT

[75] Inventor: Louis Plumer, Belfort, France

[73] Assignee: Etablissments Bubendorff (Societe Anonyme), Saint-Louis, France

[21] Appl. No.: 311,059

[22] Filed: Sep. 23, 1994

[30] Foreign Application Priority Data

Sep. 29, 1993 [FR] France ..... 93 11767

[51] Int. Cl.[6] ..... A47G 5/02; A47H 1/00; E06B 9/56

[52] U.S. Cl. ..... 160/310; 160/265

[58] Field of Search ..... 160/310, 265, 160/314, 133

[56] References Cited

U.S. PATENT DOCUMENTS

| | | | |
|---|---|---|---|
| 2,183,495 | 12/1939 | Laufersweiler . | |
| 2,347,845 | 5/1944 | Schane . | |
| 4,766,941 | 8/1988 | Sloop et al. | 160/310 X |
| 4,815,515 | 3/1989 | Lee | 160/310 X |
| 5,088,543 | 2/1992 | Bilbrey | 160/265 X |
| 5,249,616 | 10/1993 | Yen | 160/310 X |
| 5,355,927 | 10/1994 | McKeon | 160/310 X |

FOREIGN PATENT DOCUMENTS

| | | | |
|---|---|---|---|
| 0317461 | 5/1989 | European Pat. Off. . | |
| 2502597 | 10/1982 | France . | |
| 2544887 | 10/1984 | France . | |
| 2303782 | 8/1974 | Germany | 160/133 |
| 2263729 | 8/1993 | United Kingdom . | |

OTHER PUBLICATIONS

French Search Report.

*Primary Examiner*—Blair M. Johnson
*Assistant Examiner*—Brian J. Hamilla
*Attorney, Agent, or Firm*—Greenblum & Bernstein P.L.C.

[57] ABSTRACT

A driving and tensioning device for a flexible protective member such as a strip, curtain or skirt includes a rolling-up driving-shaft and an unrolling driving-shaft which are driven by electric motors provided with a brake activated in order not to brake any longer when one of these motors is under power. This driving and tensioning device furthermore includes a device for controlling the power supply to the motors so that a torque is generated by one of the motors withstanding the operation of the other motor, during the phase of either unrolling or rolling-up of the flexible protective member.

17 Claims, 1 Drawing Sheet

DRIVING AND TENSIONING DEVICE FOR A FLEXIBLE PROTECTIVE MEMBER SUCH AS A STRIP, CURTAIN OR SKIRT

BACKGROUND OF THE INVENTION

1. Field of the Invention

The invention relates to a driving an tensioning device for a flexible protective strip or curtain, comprising a rolling-up driving-shaft from which and onto which unrolls and rolls up said protective strip, and an unrolling driving-shaft acting on the flexible protective strip or curtain for unfolding same, the rolling-up driving-shaft and the unrolling driving-shaft being each driven in rotation by means of a motor associated with braking means.

2. Description of the Prior Art

There is already known a driving device for a flexible protective strip or curtain-type member meeting the above description. Thus, this driving device includes a rolling-up driving-shaft from which and onto which unrolls and rolls up the flexible member. This rolling-up driving-shaft is driven in rotation through a tubular-type motor or the like, this during this phase of rolling up of the flexible member. It should be noted that this motor is provided with an electromagnetic brake which is activated, i.e., it does no longer brake, when the motor it is associated with is in operation, i.e., rolling up, but also during the phase of unfolding controlled by the unrolling driving-shaft. As a matter of fact, like the rolling-up driving-shaft, this latter cooperates with a motor which ensures its driving in rotation during the phase of unfolding of the protective member. Here too, with this motor is associated an electromagnetic brake which is activated, i.e., which does no longer brake, as soon as one of the motors of the rolling-up driving-shaft or unrolling driving-shaft is under power.

Moreover, in this particular case, the rolling-up driving-shaft and the unrolling driving-shaft are arranged parallel to each other on both sides of the surface to be covered by means of the flexible protective member. Furthermore, this latter is initially rolled up onto the rolling-up driving-shaft and includes, at the height of its free end, straps joining the unrolling driving-shaft where they roll up onto drums this latter is provided with.

As a matter of fact, this kind of flexible protective member is aimed at unfolding in a nearly horizontal or slightly inclined position above the surface to be protected. Therefore, this raises the problem of the tensioning of this flexible member and its maintaining in such a position. Under its own weight, this flexible protective member indeed necessarily sags between the rolling-up driving-shaft and the unrolling driving-shaft, more particularly during the unfolding phase. It should indeed be reminded that during the operation of one of the motors the brakes associated to each of them are activated to enable free rotation of the rolling-up driving-shaft and the unrolling driving-shaft.

Therefore, in order to take up the slack of the flexible protective member upon unfolding, it is intended to control the operation, during a short time, of either the motor of the unrolling driving-shaft or that of the rolling-up drivingshaft. More particularly, during this short time, either the rolling-up driving-shaft or the unrolling driving-shaft, as the case may be, of the motor which is not activated is not driven in rotation because of its inertia. Consequently, there occurs no additional unrolling of either the protective member or the straps, but a mere taking up of the slack at the level of this untensioned flexible protective member. Consequently, upon the complete standstill of the motors, the brakes are deactivated and impede rotation in any direction of this rolling-up driving-shaft and the unrolling driving-shaft, to finally keep the flexible protective member tensioned.

Practical experience shows that this process is not merely theoretical, that is, for the process to work the backlash to be taken up to ensure the tensioning of the flexible protective member should be small, for otherwise the period of time during which one of the motors is actuated to ensure this tensioning is either too short or too long, so that the unrolling of said flexible protective member or the straps connected to the unrolling driving-shaft cannot simultaneously be impeded.

In order to improve the driving device as described above, there has been imagined to associate with the rolling-up driving-shaft, and auxiliary brake capable of producing a torque withstanding the rotation of this rolling-up driving-shaft during the unfolding of the protective member. More particularly, through such a resisting couple the traction which has to be exerted on the straps through the driving in rotation of the unrolling driving-shaft is higher, so that the protective member is maintained tensioned during its unfolding.

This auxiliary brake may be of a mechanical or Foucault-current type. As a matter of fact, a Foucault-current brake is efficient as soon as there exists a rotation. As a result, it can give rise to a slackening of the protective member at the end of the unfolding stroke. Therefore, it only partly solves the above-mentioned problem. A mechanical brake of the friction type often integrates a ratchet wheel so as not to enter into operation in a determined direction of rotation, i.e., in the direction of rotation followed by the rolling-up phase. Such a mechanical brake which provides a solution for the disadvantages experienced with a Foucault-current brake, however, proves particularly complex and leads to a substantial increase of the cost price of the driving device.

To this should be added that if one not only wants to ensure that the flexible protective member be tensioned when in unfolded position, but also that the straps be so once said flexible protective member has been completely or partially rolled up, it is necessary to provide both the rolling-up driving-shaft and the unrolling driving-shaft with such an auxiliary brake. One may of course imagine to combining the systems so that, after rolling-up of the flexible protective member, the motions are inverted for a short period of time by a control of the rotation of the unrolling driving-shaft, in order to obtain the tensioning of the straps. As a result, these solutions are uneconomical in one case and unpractical to be used in the other case.

Such problems of tensioning, or more particularly of keeping tensioned, are also experienced with respect to flexible protective members, of the roller blind type, the skirt of which has a nearly horizontal movement or at least with an insufficient slanting for its unfolding to occur under its own weight.

By way of an example, such a roller blind includes a rolling-up driving-shaft for the skirt rotatingly mounted in a box inside which is also fitted the unrolling driving-shaft for this skirt. As a matter, this latter is arranged below the rolling-up driving-shaft and includes, at its ends, tooth wheels engaging into openings provided for at the ends of the blades said skirt is comprised of. Thus, during the unfolding, the unrolling driving-shaft is driven in rotation through a motor which is associated to same. It also includes a brake which is activated, i.e., which does not brake when the motor is actuated and, conversely, impedes the unrolling driving-shaft from rotation in the event the motor stops operating, so as to lock in down movement the skirt of the roller blind. The brake is also activated so as not to brake any longer during the driving in rotation of the rolling-up driving-shaft through the motor which is particular to same. In this kind of configuration, this rolling-up driving-shaft for the skirt is often without electromagnetic brake. As already stated, the locking of the skirt is indeed obtained through the braking motor the unrolling driving-shaft is fitted with. Therefore, the rolling-up driving-shaft is not subjected to a large torque corresponding to the total weight of the skirt.

In addition, the motor of this rolling-up driving-shaft is associated with auxiliary braking means. Thus, the reduction gear provides a braking force capable of opposing the rotation of the rolling-up shaft under the influence of the reduction torque produced by the few blades of the skirt between the unrolling driving-shaft and that rolling-up driving-shaft.

As already stated above, the skirt of such roller blinds is made of a juxtaposition of blades which are not only hingedly jointed to each other, but are often also telescopic in a direction which is perpendicular to same, so as to be capable of imparting to the skirt an openwork position. More particularly, when the blades are kept separated from each other, they leave openings allowing light rays to pass through. As a matter of fact, this kind of telescopic jointing of the blades of a roller-blind skirt gives rise to large difficulties, in particular within the framework of roller blinds with nearly horizontal unfolding. More particularly, such roller blinds are applied to roof windows or the like. Therefore, they are particularly exposed to the elements. Thus, despite the presence of ta protective box, moisture can penetrate into the joints of the blades located inside this box and, of the blades extending between the rolling-up driving-shaft and the unrolling driving-shaft. Now, in the event of frost, this moisture becomes ice which clamps the joints of these blades, while it is just between this rolling-up driving-shaft and the unrolling driving-shaft that said joint is normally under highest strain. Therefore, when the user tries to actuate its roller blind under these circumstances, the skirt often brakes at the level. It should be noted that these breaks only occur in the event two successive blades are kept substantially edge to edge, in which position they can no longer pivot with respect to each other.

This means that the blades of the skirt length between the rolling-up driving-shaft and the unrolling driving-shaft should be kept steadily apart so that they can at any time pivot with respect to each other, whereby they impede the frost from immobilizing them in an edge-to-edge position.

In addition, since the rolling-up of the skirt is achieved only under the driving in rotation of the rolling-up driving-shaft, the motor must necessarily have a sufficient torque, so as to be able to compensate for the torque produced by total weight of the skirt. Now, this excessive torque is a handicap in the event of clamping of the skirt, e.g., in its upper portion, accommodated in the box. Since it is higher than the mechanical strength of the skirt, it can indeed lead to the breaking of this latter.

Finally, one should note that in order to deliver this high power, the motor should be of an appropriate size. It is therefore also relatively expensive. It is therefore cheaper to adapt the power of the motor to the size of the roller blinds rather than using a standard motor for a series of roller blinds. This does not avoid that this solution, adopted so far, makes stiffer the control of the manufacturer and that of the stocks.

SUMMARY OF THE INVENTION

The scope of this invention is just to provide a solution for the disadvantages experienced in the above-mentioned cases, this by means of simple solutions which implement standard and consequently cheaper material.

For this purpose, the invention relates to a driving and tensioning device for a flexible protective member such as a strip, curtain or skirt, comprising a rolling-up driving-shaft from which and onto which unrolls and rolls up said flexible protective member, and an unrolling driving-shaft acting this latter, either directly or through transmission means, for unfolding same. The rolling-up driving-shaft and the unrolling driving-shaft are each driven in rotation by means of a motor, and each motor is associated with braking means activated in order not to brake when one of the motors is actuated. This device furthermore including means for controlling the power supply to the motors capable of ensuring the operation, at reduced power and in the opposite direction with respect to the actuation, of the motor of the rolling-up driving-shaft or of the unrolling driving-shaft, when the device is in in the rolling-up or unrolling phase, respectively, to create a torque withstanding this actuation controlled by the operation of the motor, respectively, of the unrolling driving-shaft or rolling-up driving-shaft.

The invention also relates to a driving and tensioning device for a flexible protective member such as a strip, curtain or skirt, comprising a rolling-up driving-shaft from which and onto which unrolls and rolls up said flexible protective member, and an unrolling driving-shaft acting onto this latter, either directly or through transmission means, for unfolding same, the rolling-up driving-shaft and the unrolling driving-shaft being each driven in rotation by means of a motor with which are associated braking means activated in order not to brake any longer when one of these motors is under power, this device furthermore including means for controlling the power supply to the motors capable of ensuring the operation, at reduced speed and in the same direction as the actuation, of the motor of the rolling-up driving-shaft or of the unrolling driving-shaft, according to one being in the rolling-up or unrolling phase, respectively, to create a torque withstanding this actuation controlled by the operation of the motor or of the unrolling driving-shaft, respectively of the rolling-up driving-shaft.

Finally, the invention relates to a driving and tensioning device for a flexible protective member such as a strip, curtain or skirt, comprising a rolling-up driving-shaft from which and onto which unrolls and rolls up the flexible protective member, and an unrolling driving-shaft acting onto this latter, either directly or through transmission means, for unfolding same the rolling-up driving-shaft and the unrolling driving-shaft being each driven in rotation by means of a motor with which are associated braking means eventually activated in order not to brake any longer when one of these motors is under power, this device furthermore including means for controlling the power supply to these motors capable of enduring, at least during the rolling-up phase, the operation, on the one hand, of the motor of the rolling-up driving-shaft at reduced speed and, on the other hand, of the motor of the unrolling driving-shaft at it nominal power and in the direction of the actuation.

The advantages achieved by means of this invention mainly reside in that it is possible to maintain the tension of the flexible protective member, without having recourse to auxiliary braking means which are often complex, and consequently, expensive. Furthermore, the unfolding or rolling-up controls of the flexible member occur with great ease in that it is not necessary, in the event of stopping of the unfolding or rolling-up control of this flexible member, to ensure the temporary operation of this or that motor to achieve the tensioning of either the flexible member itself or the straps which are associated to same.

In addition, the maintaining of the tensioning at the level of the flexible member, such as a skirt of a roller blind for a roof window or the like, this between the rolling-up driving-shaft and the unrolling driving-shaft solves to a large extent the drawbacks experienced at that level and in the even of frost which such roller blinds. In addition by combinedly controlling the operation of the motors, one avoids, in the framework of an application to such roller blinds, the use of an overpowered motor to ensure the rolling-up of the skirt onto the rolling-up driving-shaft, this latter being capable of being assisted during this operation by the motor of the unrolling driving-shaft. This allows to provide a solution for the problem of the breaking of the skirt usually caused by a such overpowered motors.

Finally, by relieving the effort produced by the motor of the rolling-up driving-shaft further to the assistance provided by the motor of the unrolling driving-shaft, one notices that it can also be contemplated to go toward a standardization of these motors. Indeed, for reasons of manufacturing costs, which are lesser in the framework of a mass production, the motors are preferably chosen of identical characteristics.

BRIEF DESCRIPTION OF THE DRAWINGS

The understanding of this invention will be made easier with reference to the attached drawing in which:

FIG. 2 is a schematical perspective view of a driving and tensioning device for a flexible protective member in the shape of a roller blind skirt applicable e.g. to roof windows or the like.

DESCRIPTION OF THE PREFERRED EMBODIMENTS

Figure 1:
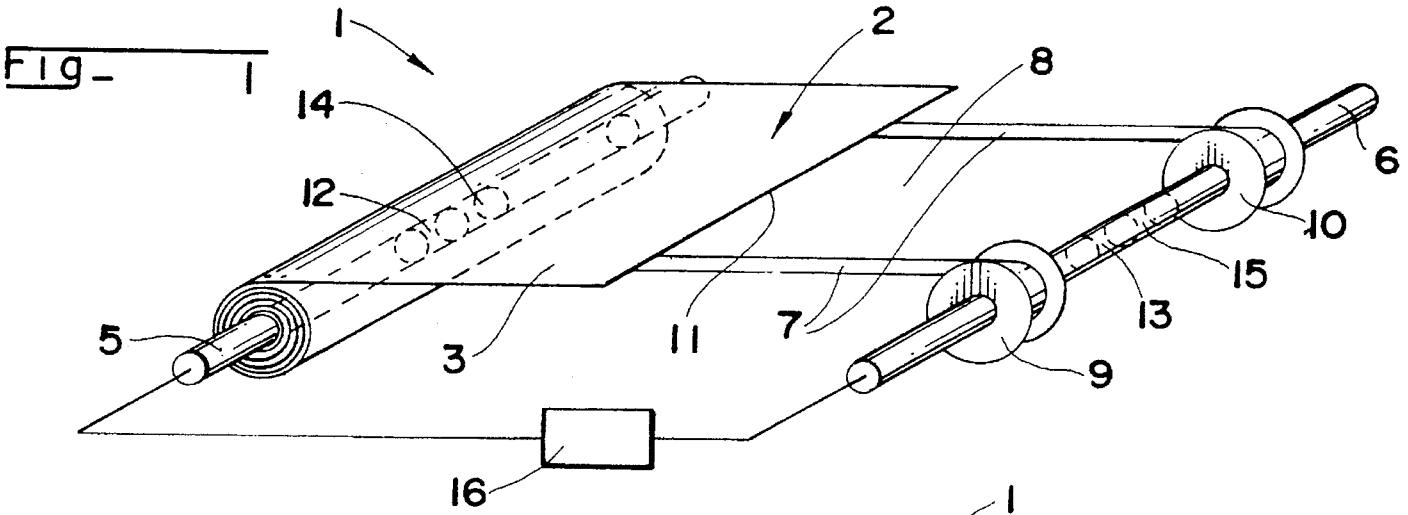
FIG. 1 is a schematical perspective view of a driving and tensioning device for a flexible protective member such as a strip or curtain which unfolds nearly horizontally.
Figure 2:
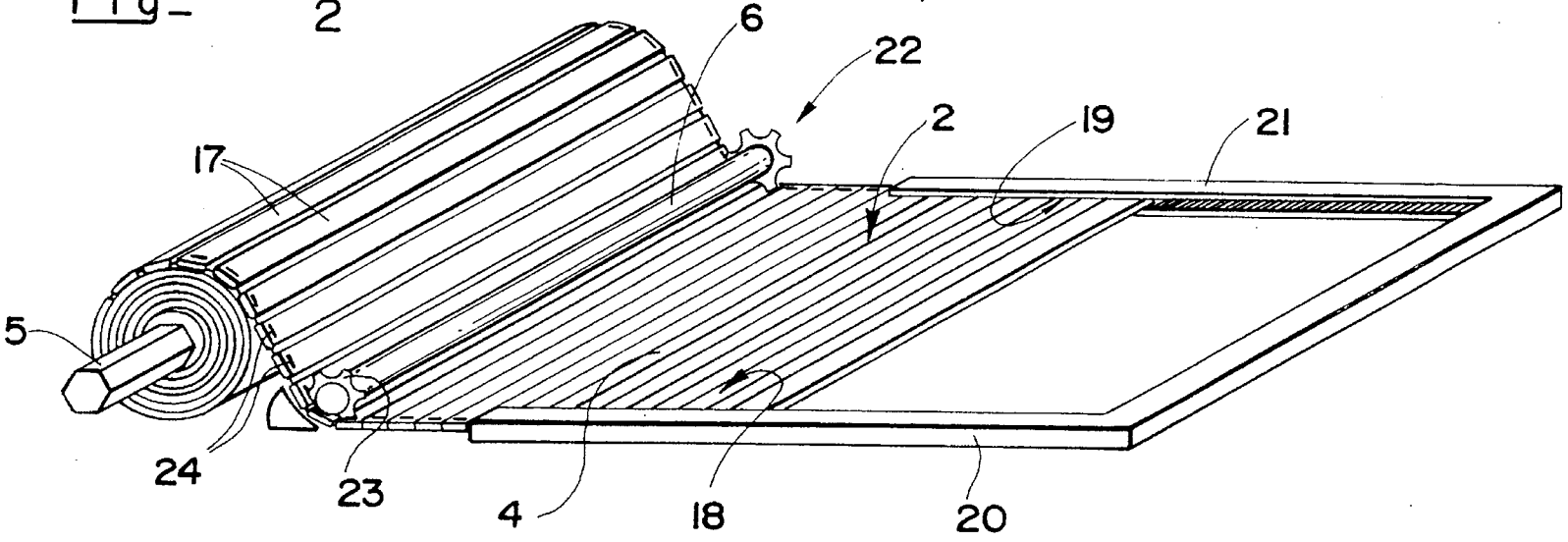

As shown in the Figures of the attached drawing, this invention relates to a driving and tensioning device 1 for a rolling-up flexible protective member 2 such as a strip or curtain 3 as shown in FIG. 1 or such as a skirt 4 for a roller blind as shown in FIG. 2.

As a matter of fact, this driving and tensioning device 1 is aimed at ensuring the horizontal unfolding, or with a slight slant, of this flexible protective member 2. Therefore, it includes first of all a rolling-up driving-shaft 5 from which and onto which unrolls and rolls up the flexible protective member 2. It furthermore comprises an unrolling driving-shaft 6 acting onto this flexible protective member 2, either directly, as shown in FIG. 2, or through transmission means 7, e.g., straps, corresponding to the embodiment of FIG. 1, for unfolding the same.

When referring more particularly to the embodiment shown in FIG. 1 showing a driving and tensioning device for a flexible protective member 2 such as a strip or curtain 3, the unrolling driving-shaft 6 is arranged parallel to the rolling-up driving-shaft 5 and is located, with respect to this latter, on the other side of the surface 8 to be covered and protected. Onto this unrolling driving-shaft 6 are fitted drums 9, 10 onto which roll up straps forming the transmission means 7 connected to the free end 11 of the flexible protective member 2. The rolling-up driving-shaft 5 and the unrolling driving-shaft 6 are each driven in rotation by means of an electric motor 12, 13, respectively, which, as shown, may be of the tubular type or even installed at the end of the shaft. With each of these motors 12, 13 are associated braking means 14, 15, comprised, e.g., of an electromagnetic-type brake. This brake 14, 15 is activated, i.e., it does not brake, when any one of the motors 12, 13 is under power. Thus, in the event these motors 12, 13 stand still the brakes 14, 15 are deactivated so that the rolling-up driving-shaft 5, and the unrolling driving-shaft 6, respectively, is locked from rotation.

According to a feature of the invention, the driving and tensioning device 1, within the framework of the embodiment shown in FIG. 1, includes means 16 for controlling the power supply of these motors 12, 13 capable of ensuring the operation, at reduced power and in the opposite direction with respect to the actuation being carried out of the motor 12, 13 of the rolling-up driving-shaft 5 or the unrolling drivingshaft 6, according to whether one passes into the unfolding or rolling-up phase, respectively, of the flexible member 2. Thus, by way of an example, during the unfolding phase, not only is the motor 13 under power so as to drive in rotation the unrolling driving-shaft 6, causing the transmission means 7 to roll up onto the drums 9, 10, but also the motor 12 of the rolling-up driving-shaft 5, however at reduced power and in the opposite direction with respect to the actuation being carried out, i.e., the unfolding of the flexible member 2. Thus, this motor 12, which operates reversely, generates a torque withstanding the actuation controlled by the operation of the motor 13 of the unrolling driving-shaft 6. This situation is the same, however reversed, during the phase of folding-up of the flexible member 2. In this case, the motor 12 of the rolling-up driving-shaft 5 is normally supplied with power while the motor 13 of the unrolling driving-shaft 6 is supplied with reduced power and operates reversely with respect to the actuation, in order to generate a resisting torque.

This resisting torque can also be achieved by ensuring the operation of the motor 12, 13 in the same direction as the actuation being carried out, but at a lower speed than that of the motor 13, 12, respectively, according to whether one is unfolding or folding up the flexible member 2.

One should observe that within the framework of this embodiment according to the invention, the power of the motors 12, 13 may be more reduced, since these latter mutually assist each other during the various actuations.

In all cases, whether under the action of a reduced-power supply to the motors tending to have them rotate in the opposite direction with respect to the actuation being carried out or under the action of a slower rotation speed of one of these motors 12, 13 with respect to the other 13, 12, respectively, according to whether one is in the unfolding or folding-up phase, respectively, the so produced resisting torque at the level of the rolling-up driving-shaft 5 or of the unrolling driving-shaft 6 guarantees the maintaining tensioned of the flexible member 2 both during the actuations and at the standstill of these motors 12, 13.

Consequently, one observes that through simple means for controlling the operation of these motors 12, 13 and this without auxiliary brake or the like, it is possible to guarantee a perfect tensioning of a flexible member 2 both during and after the actuation.

Within the framework of a more particular application to a flexible member 2 such as a skirt 4 of a roller blind, one observes that the unrolling driving-shaft 6 is located parallel to and substantially downstream with respect to the rolling-up driving-shaft 5 from and onto which rolls up the skirt 4. It should be noted that this latter is designed by a juxtaposition of blades 17 connected to each other by means of hinged joints often of a telescopic nature.

It should be noted that during the unfolding the ends of these blades 17 and consequently of the side edges 18, 19 of the skirt 4 move in guiding rails 20, 21.

In this particular case, the unrolling driving-shaft 6, being arranged downstream with respect to the rolling-up driving-shaft, directly acts onto the blades 17 of the skirt 4 of the flexible member 2. As a matter of fact, this unrolling driving-shaft 6 includes, at its ends, driving means 22, 23 in the shape of toothed wheels cooperating with the blades 17 and engaging into openings 24 made at the level of the ends of these latter.

Here too, in order to maintain a certain tensioning between the blades 17 when they enter the area between the rolling-up driving-shaft 5 and the unrolling driving-shaft 6, means 16 for controlling the power supply to the motors 12, 13 associated with this rolling-up driving-shaft 5 and the unrolling driving-shaft 6, respectively, may guarantee the power supply at reduced power and in the opposite direction with respect to the actuation being carried out during the unfolding and the folding-up, respectively, of the flexible member 2.

Thus, by way of an example, during the folding up of this flexible member 2, the motor 12 of the rolling-up driving-shaft 5 is appropriately supplied with power, while the motor 13 of the unrolling driving-shaft 6 is supplied with reduced power and in the opposite direction so as to produce a torque withstanding the folding-up control of the flexible member 2.

However, one observes that within the framework of such a control of the operation of the motors 12, 13 and, e.g., during the folding-up of the flexible member 2, the motor 12 associated with the rolling-up driving-shaft 5 should have a power not only sufficient to face the total weight of the skirt 4, but in addition to mitigate the resisting torque generated by the motor 13 of the unrolling driving-shaft 6.

Therefore and according to the invention, it is intended more particularly within the framework of such an application to a roller blind and during the phase of rolling up of the skirt, to ensure through control means 16 the operation of the motor 13 in the same direction as the actuation being carried out, but at reduced speed compared to the motor 12 acting onto the rolling-up driving-shaft 5. It is obvious that under such circumstances the motor 13 operating at reduced speed controls the speed rate of the skirt 4 and cause a tensioning at the level of the skirt 4, more particularly in the area between the unrolling driving-shaft 6 and the rolling-up driving-shaft 5. Therefore, the blades 17 the skirt 4 are steadily kept apart from each other so as to release their hinged joint.

As a matter of fact, this solution consisting in having the motors 12, 13 rotate in the same direction during an unfolding actuation, or more particularly a folding-up, of the skirt 4 has the advantage that these motors 12, 13 mutually assist each other during these various actuations. This means that with a motor of a given power one is capable of unfolding or rolling up a larger and heavier skirt compared to a prior situation. IN a short word, this means that motors of a given power are capable of meeting a larger range of roller blinds. Finally, this standardization of the motors contributes to a large extent to a reduction of the cost price of such a roller blind.

It should however be observed that electrical or electronic means for controlling the rotation speed of motors, e.g., asynchronous motors, often used in this field have a non-neglectible cost price. It is more economical to use control means for the power supply to the motors in the shape of power regulators. Thus, achieving the intended result i.e., maintaining tensioned the length of the skirt 4 between the rolling-up driving-shaft 5 and the unrolling driving-shaft 6, there is contemplated according to the invention to use means 16 for controlling the power supply to the motors 12, 13 capable of ensuring, at least during the rolling-up phase, the operation of, on the one hand, the motor 12 of the rolling-up driving shaft 5 at reduced power and, on the other hand, of the motor 13 of the unrolling driving-shaft 6 at nominal power and in the direction of the actuation, i.e., in the direction of rolling-up of the skirt 4.

It is however desirable to ensure, under these circumstances, that the theoretical linear speed imparted to the skirt 4 by the rolling-up driving-shaft 5 be systematically higher than the actual linear speed imparted to this skirt 4 through the unrolling driving-shaft 6. As a matter of fact, by using motors 12, 13 of identical characteristics, the problem actually arises only during the initial phase of rolling-up of the skirt 4 onto the rolling-up driving-shaft 5. During this phase it is indeed necessary to ensure that the blades 17 of the skirt 4 be kept apart from each other so that their respective hinged joints be released and that they be capable of rolling up onto the rolling-up driving-shaft 5 while resting on same. Consequently, by ensuring that the theoretical linear speed liable of being imparted to the skirt 4 by the rolling-up driving-shaft 5 right from the initial phase of this rolling-up is higher than the linear speed liable of being imparted to the skirt 4 through the unrolling driving-shaft 6, one is sure that a tensioning is steadily exerted onto the skirt 4 between this rolling-up driving-shaft 5 and the unrolling driving-shaft 6, which tensioning leads to the separation of the blades 17 from each other. It is obvious that this theoretical linear speed imparted to the skirt 4 through the rolling-up driving-shaft 5 progressively increases as the skirt forms windings about this rolling-up driving-shaft 5.

To achieve the above result, the present invention may adapt the rotation speed of the motor 13 through control means 16 while ensuring through same the operation at reduced power of the motor 12 associated with the rolling-up driving-shaft 5. This solution has however the disadvantage of complicating the configuration of the control means 16 and as a result of making them particularly expensive. As a matter of fact, an advantageous solution consists in choosing a sufficiently large diameter for the rolling-up driving-shaft 5, i.e. which right from the initial phase of rolling up allows to ensure, under the action of the rotation of the motor 12, a theoretical linear speed of the skirt 4 which is higher than the actual linear speed imparted to this skirt 4 through the unrolling driving-shaft 6 and thus the motor 13. More particularly, the diameter of the toothed wheels 23 the unrolling driving-shaft 6 is fitted with at its ends and which engages into the openings 24 provided in the skirt 4.

It should be stated that within the framework of such an application to a roller blind the braking means 14, 15 associated with the motor 12, 13 can be formed, like within the framework of the preceding embodiment, by an electromagnetic brake directly coupled to each of these motors 12, 13. However, because of the small distance between the rolling-up driving-shaft 5 and the unrolling driving-shaft 6, it is in fact enough to associate such an electromagnetic brake only with the motor 13 of the unrolling driving-shaft 6, this mainly in order to guarantee the locking of the skirt 4 in any position and that it will not automatically unfold under its own weight. Braking means directly depending on the configuration of the motor 13 and speed-regulator-type driving means associated to the same are in this case indeed sufficient to maintain tensioned the blades of the skirt length between the rolling-up driving-shaft 5 and the unrolling driving-shaft 6 after standstill of the motors 12, 13.

To conclude, as this appears from the above description, this invention not only provides a solution for a real technical problem regarding the horizontal unfolding, or with a slight slant, of a flexible protective member, but in addition, thanks to its simplicity, proves to be of a reduced cost price and allows some standardization at the level of the manufacturing. Therefore, this invention represents a clear technical progress in the field concerned.

What is claimed is:

1. A driving and tensioning device for a flexible protective member and a flexible protective member comprising one of a strip, a curtain, and a skirt, said device comprising:

a rolling-up driving-shaft rolling said flexible protective member;

and an unrolling driving-shaft acting on said flexible protective member for unfolding said flexible protective member;

each of said rolling-up driving-shaft and said unrolling driving-shaft being each driven in rotation by a respective electric rolling and unrolling motor;

said rolling and unrolling motors each associated with a respective braking means, wherein said braking means do not brake when one of said rolling and unrolling motors is activated;

said device further including means for controlling power supplied to said motors to create a torque during a rolling and an unrolling operation, wherein during said unrolling operation, said controlling means supplies a reduced power to said rolling motor in a direction opposite an unrolling direction, the reduced power to said rolling motor being less than a power supplied to said unrolling motor, and wherein, during said rolling operation, said controlling means supplies a reduced power to said unrolling motor in a direction opposite a rolling direction the reduced power to said unrolling motor being less than a power supplied to said rolling motor.

2. The driving a tensioning device according to claim 1, said flexible protective member comprising a strip with one of a horizontal and a slightly inclined movement direction during said rolling up and said unrolling operation;

said rolling-up driving-shaft and said unrolling driving-shaft being positioned in parallel and said unrolling driving-shaft including drums for rolling up respective straps forming a transmission means connected to a free end of said flexible protective member.

3. The driving and tensioning device according to claim 1, said flexible protective member comprising a skirt for roller blinds, said skirt comprising of a plurality of blades connected to each other and including openings capable of co-operating with a driving means associated with said unrolling driving-shaft;

said unrolling driving-shaft positioned parallel and downstream with respect to said rolling-up driving shaft.

4. The driving and tensioning device according to claim 1, said unrolling driving-shaft being directly coupled to said flexible protective member.

5. The driving and tensioning device according to claim 1, said unrolling driving-shaft being coupled to said flexible protective member through a transmission means.

6. A driving and tensioning device for a flexible protective member, and a flexible protective member comprising one of a strip, a curtain, and a skirt, said device comprising:

a rolling-up driving-shaft for rolling said flexible protective member;

and an unrolling driving-shaft acting on said flexible protective member for unfolding said flexible protective member;

each of said rolling-up driving-shaft and said unrolling driving-shaft being driven in rotation by a respective electric rolling and unrolling motor, said rolling and unrolling motor each associated with respective braking means wherein said braking means do not brake when one of said rolling and unrolling motors is activated, said device further including means for controlling power supplied to said motors to create a torque during a rolling and an unrolling operation;

wherein, during said unrolling operation, said controlling means supplies a reduced power to said unrolling motor in a direction of said unrolling operation, said reduced power to said unrolling motor being less than a power supplied to said rolling motor, wherein, during said rolling operation, said controlling means supplies a reduced power to said rolling motor in a direction of said rolling said reduced power to said rolling motor being less than a power supplied to said unrolling motor.

7. The driving and tensioning device according to claim 6, said flexible protective member comprising a strip with one of a horizontal and a slightly inclined movement direction during said rolling and said unrolling operation;

said rolling-up driving-shaft and said unrolling driving-shaft being positioned in parallel; and said unrolling driving shaft including drums for rolling up respective straps forming a transmission means connected to a free end of the flexible protective member.

8. The driving and tensioning device according to claim 6, said flexible protective member comprising a skirt for roller blinds, said skirt comprising of a plurality of blades connected to each other and including openings capable of cooperating with driving means associated with said unrolling driving-shaft, and said unrolling driving-shaft positioned parallel and downstream with respect to said rolling-up driving-shaft.

9. The driving and tensioning device according to claim 6, said unrolling driving-shaft being directly coupled to said flexible protective member.

10. The driving and tensioning device according to claim 6, said unrolling driving-shaft being coupled to said flexible protective member through a transmission means.

11. A driving and tensioning device for a flexible protective member, and a flexible protective member comprising one of a strip, a curtain, and a skirt, said device comprising:

a rolling-up driving-shaft for rolling said flexible protective member; and an unrolling driving-shaft acting on said flexible protective member for unfolding said flexible protective member;

each of said rolling-up driving-shaft and said unrolling driving-shaft being each driven in rotation by a respective electric rolling and unrolling motor;

said rolling and unrolling motor each associated with respective braking means, wherein said braking means do not brake when one of said motors is activated;

said device further including means for controlling power supplied to said motors, wherein during an initial phase of a rolling operation, said controlling means supplies a reduced speed to said rolling motor and supplies nominal power to said unrolling motor and in a direction of rolling said nominal power to said unrolling motor producing a speed to said unrolling motor less than the reduced speed supplied to said rolling motor, said reduced speed supplied to said rolling motor being less than a speed supplied to said rolling motor in a later phase of said rolling operation.

12. The driving and tensioning device according to claim 11, said flexible protective member comprising a skirt for roller blinds, said skirt comprising a plurality of blades connected to each other and including openings capable of co-operating with driving means associated with said unrolling driving-shaft.

13. The driving and tensioning device according to claim 11, said flexible protective member shaped as a skirt for roller blinds, said skirt comprising of a plurality of blades connected to each other and including openings capable of co-operating with driving means associated with said unrolling driving-shaft, said unrolling driving shaft positioned parallel and downstream with respect to the rolling-up driving shaft, said driving device including, means for ensuring, from an initial phase of rolling-up of said skirt, a theoretical linear speed for said skirt, said speed of said rolling-up driving-shaft being greater than that of said unrolling driving-shaft.

14. The driving and tensioning device according to claim 13, said ensuring means are formed by said control means to respond to a rotational speed of said unrolling motor associated with said unrolling driving-shaft.

15. The driving and tensioning device according to claim 13, said ensuring means being formed by a diameter of said rolling-up shaft sufficient to achieve, under rotation of said rolling motor operating at reduced power, a theoretical linear speed of said skirt higher than an actual linear speed imparted to said skirt by said unrolling driving-shaft during rotation of said unrolling motor at its nominal speed, during said initial phase of rolling-up.

16. The driving and tensioning device according to claim 11, said unrolling driving-shaft being directly coupled to said flexible protective member.

17. The driving and tensioning device according to claim 11, said unrolling driving-shaft being coupled to said flexible protective member through a transmission means.

* * * * *